US005448939A

United States Patent [19]

Findlay, Sr. et al.

[11] Patent Number: 5,448,939

[45] Date of Patent: * Sep. 12, 1995

[54] FIREARM WITH MULTIPLE SEARS

[75] Inventors: David Findlay, Sr., Guilford, Conn.; David S. Findlay, Ilion; Floyd H. Smith, Mohawk, both of N.Y.

[73] Assignee: Remington Arms Company, Inc., Wilmington, Del.

[ * ] Notice: The portion of the term of this patent subsequent to Dec. 20, 2011 has been disclaimed.

[21] Appl. No.: 275,260

[22] Filed: Jul. 15, 1994

Related U.S. Application Data

[63] Continuation of Ser. No. 868,943, Apr. 16, 1992, Pat. No. 5,373,775.

[51] Int. Cl.[6] ..... F41A 17/36; F41A 19/32

[52] U.S. Cl. ..... 89/137; 42/69.02; 89/145

[58] Field of Search ..... 42/69.01, 69.02; 89/137, 138, 139, 141, 144, 145

[56] References Cited

U.S. PATENT DOCUMENTS 985,156 2/1911 Frommer ..... 42/69.02
1,024,932 4/1912 Haeghen ..... 89/137
1,245,889 11/1917 Duflot ..... 42/69.02
2,224,758 12/1940 Brewer ..... 89/139
3,447,525 6/1969 Cermak et al. ..... 42/69.02

FOREIGN PATENT DOCUMENTS 278024 12/1951 Switzerland ..... 42/69.02

*Primary Examiner*—Stephen C. Bentley
*Attorney, Agent, or Firm*—Donald W. Huntley

[57] ABSTRACT

A firearm having a disconnector movable in two planes to disconnect the gun if the bolt moves rearward, disconnects the gun if the magazine box is removed and is the connecting member between the trigger and the sears. The firearm has a double sear both of which must be released from the firing pin carrier before the firing pin carrier can move into a firing mode. The firing pin carrier has an indicator visible to the operator to indicate whether or not the gun is in a firing mode. The magazine latch has an integral ejector and the barrel has projections between the magazine box is received to align the magazine box to the chamber mouth. Additionally, there is a firing pin retractor plunger in the bolt which separates the firing pin carrier from the bolt immediately after firing to enhance ejection of spent rounds.

3 Claims, 6 Drawing Sheets

FIREARM WITH MULTIPLE SEARS

This is a continuation of application Ser. No. 07/869,943, filed Apr. 16, 1992, now U.S. Pat. No. 5,373,775.

BACKGROUND OF THE INVENTION

This invention relates to a rim fire rifle incorporating several safety and convenience features associated with the disconnector, sears, cocked position indicator, barrel feed projections for aligning the magazine box and a firing pin retraction plunger system; as well as an integral magazine latch and ejector.

SUMMARY OF THE INVENTION

It is the purpose of this invention to provide a disconnector that moves in two planes which enables the disconnector to disconnect the rifle as the bolt moves rearward, disconnects the rifle if the magazine box is removed and functions as the connecting member between the trigger and sears.

It is an object of the invention to provide a double sear which prevents doubling of the rifle due to a high velocity or low velocity follow-down malfunction. The double sear also prevents the possibility of a slam fire.

It is also an object of this invention to provide a tail on the firing pin carrier which will indicate to the operator if the gun is in the cocked and ready-to-fire mode, or in a non-fire condition.

It is a further object of this invention to provide projections on the barrel that will always align the magazine box to the chamber mouth.

It is an additional object of this invention to provide a firing pin retract plunger system which retracts the firing pin from the breech bolt face to optimize ejection of spent cases.

It is also an object of this invention to provide an integral magazine latch and ejector.

It is a further object of this invention to provide an integral scope mount on the receiver.

DESCRIPTION OF THE PREFERRED EMBODIMENT

Figure 1:
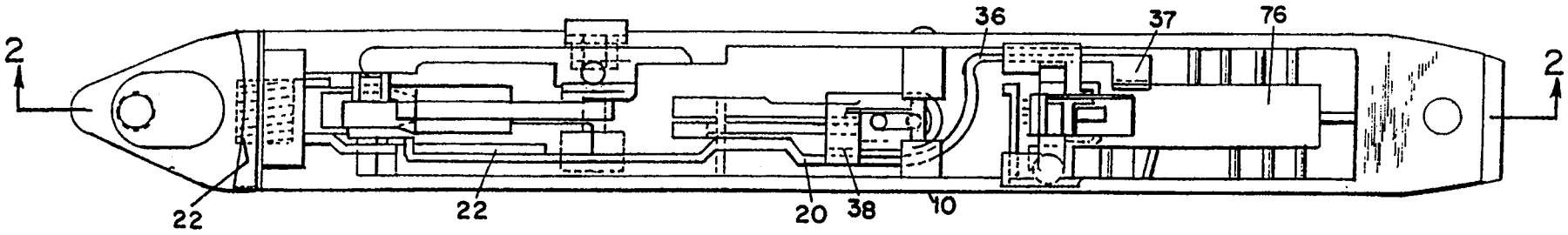
FIG. 1 is a top plane view of the gun housing.
Figure 2:
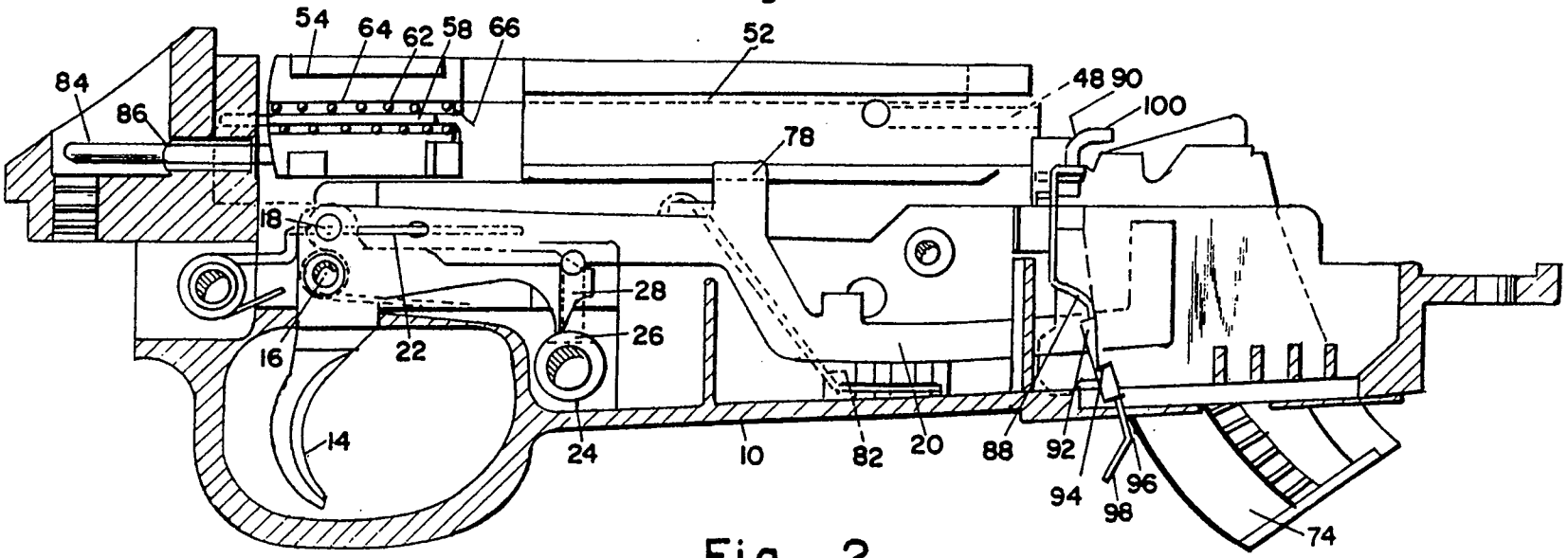
FIG. 2 is a sectional view taken along the Line 2—2 of FIG. 1.
Figure 3:
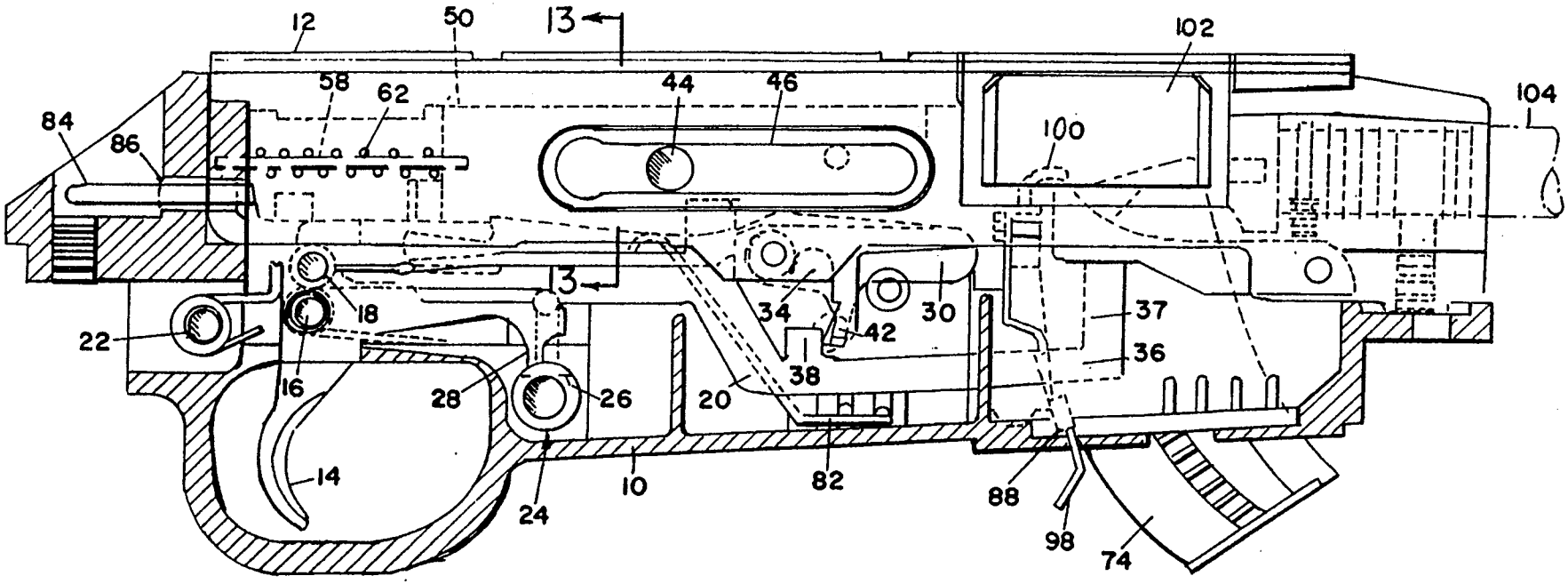
FIG. 3 is a side view similar to FIG. 2 with the receiver being shown mounted on the housing.

Attention is now directed to FIGS. 1 to 3 which illustrate the firearm of this invention having a housing 10 and a receiver 12. A trigger 14 is pivotally carried at 16 in housing 10 and has an upper portion 18 upon which the disconnector 20 is loosely pivoted. Spring 22 (see FIG. 2) biases the disconnector 20 outwardly. A safety 24 with a land 26 engages extension 28 on the trigger 14, which in one position permits the trigger to be pivoted and in another position locks the trigger from movement.

The disconnector 20 extends forwardly in the housing and then downwardly to a position underneath the sears 30, 32 (FIG. 5) which are pivotally carried in the flange 34 of the receiver 12. The disconnector 20 also has a forwardly extending offset portion 36 with a magazine box engaging flange 37. The sear engaging member 38 of the disconnector extends inwardly toward the flanges 40, 42 (FIG. 5) on the sears.

Bolt handle 44 extends through the opening 46 in the receiver 12 and is attached to bolt 48. The receiver 12 has an axially aligned rib 50 which is received in an axially aligned recess 52 in the bolt. A firing pin carrier 54 carries the firing pin 56. The firing pin carrier 54 is guided on the rods 58, 60 extending from the housing. Surrounding rod 58 is a spring 62 in the opening 64 in the firing pin carrier. The spring 62 abuts the housing and the shoulder 66 in the firing pin carrier.

The sears 30, 32 extend rearwardly and have shoulders 68, 70 adapted to engage the forward edge 72 of the firing pin carrier.

Figure 5:
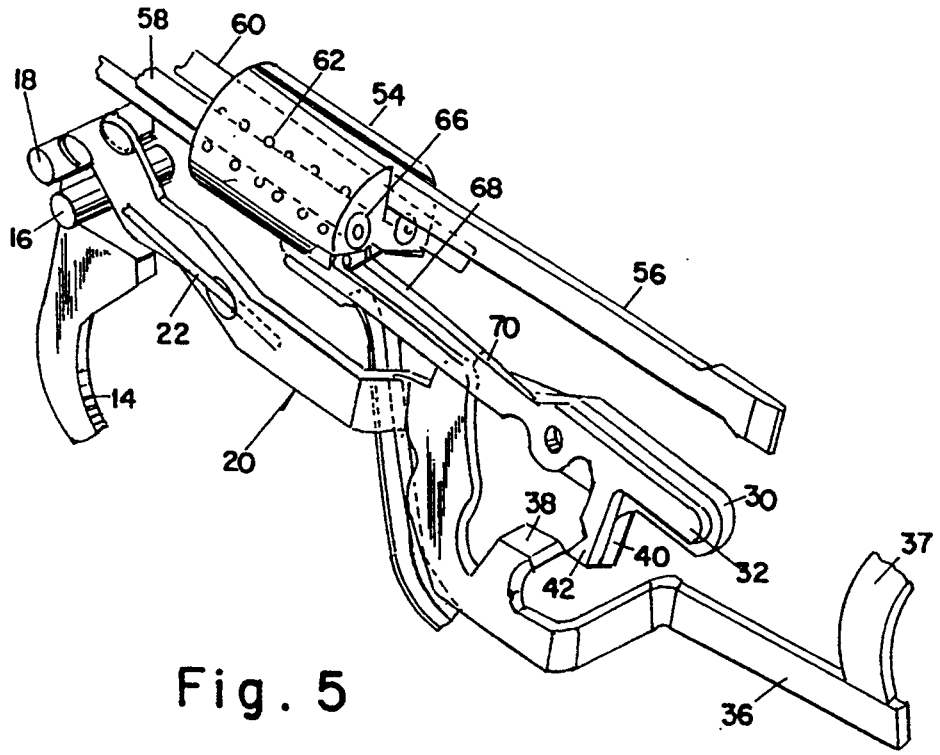
FIG. 5 is a perspective view of the disconnector disengaged from the sears.
Figure 6:
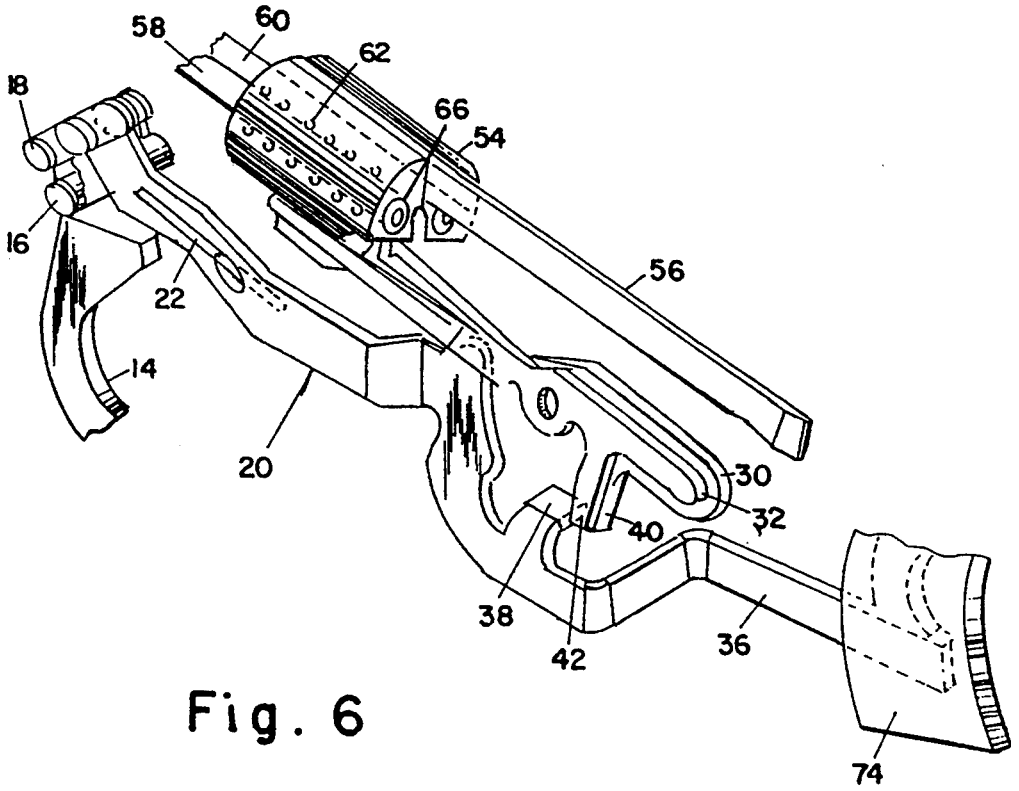
FIG. 6 is a perspective view of the disconnector engaging the sears when the magazine box moves the disconnector laterally or horizontally as the magazine box is inserted into the gun.

Attention is now directed to FIG. 5 which illustrates the spring 22 normally biasing the disconnector outwardly so that the sear engaging member 38 of the disconnector 20 is laterally spaced from the sear flanges 40, 42. As the magazine box 74 is inserted into the opening 76 in the housing, the box engages flange 37 moving the disconnector inwardly until the sear engaging flange 38 on the disconnector is aligned under the flanges 40, 42 of the sears (see FIGS. 1 and 6).

Figure 7:
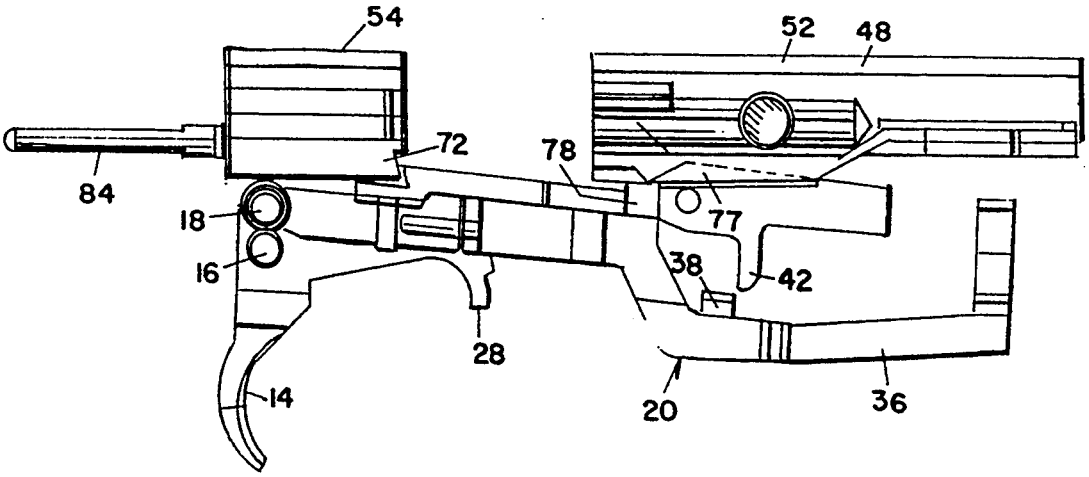
FIG. 7 is a side view illustrating the disconnector moved downwardly disengaged from the sears as the bolt is moved rearwardly.
Figure 8:
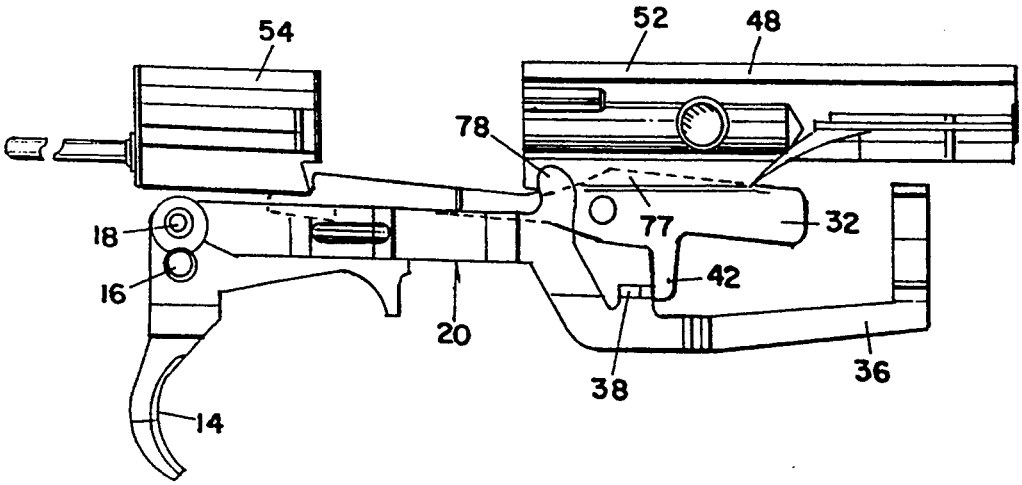
FIG. 8 is a side view illustrating the disconnector moved upwardly engaging the sears as the bolt moves forwardly.

Attention is now directed toward FIG. 7 which illustrates the bolt 48 being moved rearwardly to a cocking position. As the bolt moves rearwardly, the land 77 on the bolt engages the flange 78 on the disconnector 20 moving the disconnector downwardly so that the flange 38 is below the sear flanges 40, 42. As the bolt is returned forwardly to the firing position, the flange 78 disengages the land 77 and the spring 22 biases the disconnector upwardly permitting the flange 38 to engage sear flanges 40, 42.

Thus, it can be seen that the disconnector, by moving in two planes, performs the multiple functions of disconnecting the rifle as the bolt moves rearward, disconnects the rifle if the magazine is removed, and is the connecting member between the trigger and the sears.

Figure 9:
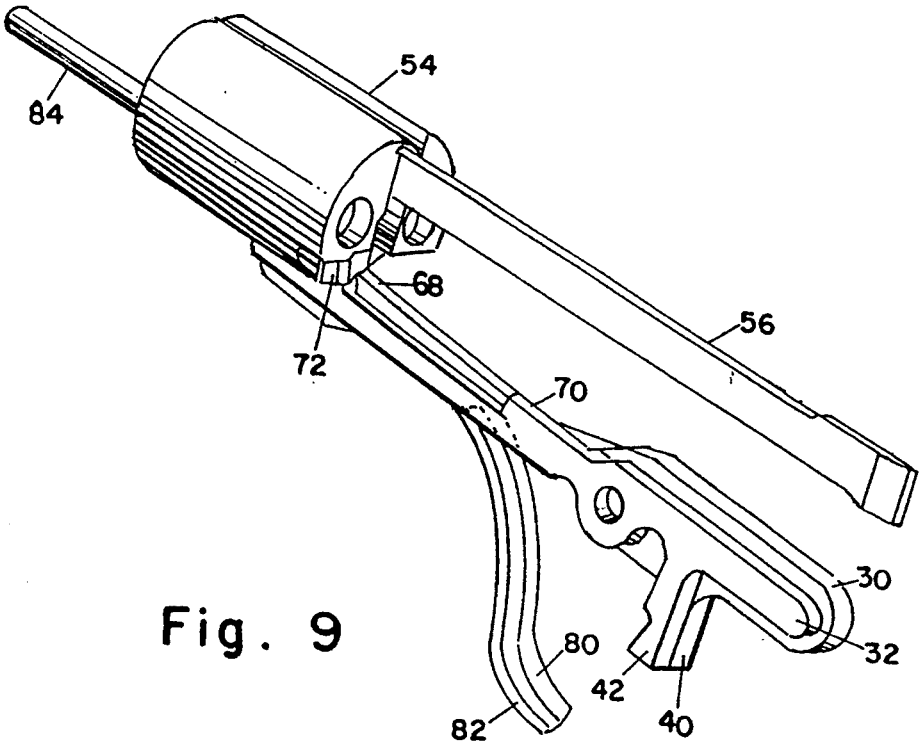
FIG. 9 is a perspective view illustrating the firing pin carrier assembly engaged with the primary sear.
Figure 10:
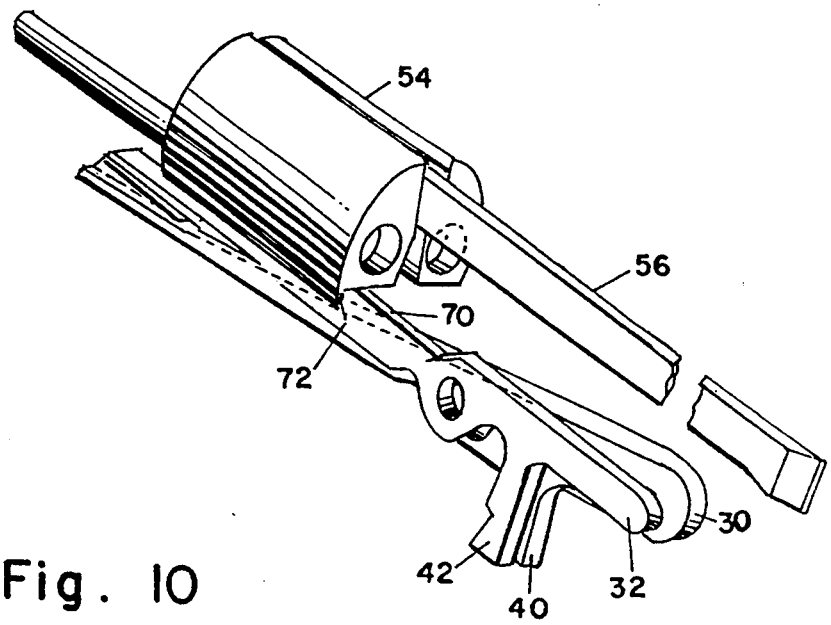
FIG. 10 is a perspective view illustrating the firing pin carrier assembly engaged with the secondary sear.

Attention is now directed to FIGS. 9 and 10 which illustrate the double sear safety feature of this invention. The primary sear 30 has the shoulder 68 which engages the firing pin carrier. The secondary sear 32 has the shoulder 70 which can also engage the firing pin carrier. The sears 30, 32 are biased upwardly by springs 80, 82 fastened to the housing. In normal operation, as the trigger pivots, the disconnector moves forward and with flanges 38, 40, 42 engaged, the sears are pivoted to disengage the firing pin carrier. This permits the spring 62 to move the firing pin carrier and firing pin forward. However, with the double sear arrangement should the rifle be dropped while in the firing mode, should the primary sear release the firing pin carrier, the shoulder 70 on secondary sear 32 will engage the firing pin carrier, preventing further forward movement of the firing pin carrier (see FIG. 10) toward the loaded round.

Attention is now directed to FIG. 2 which illustrates the indicator 84 on the firing pin carrier 54. When the firing pin carrier is in the rearward position with the gun cocked, the indicator extends through the opening 86 in the housing and is visible to the operator. With the indicator being visible, the operator will know the gun is cocked and ready to fire. If the indicator is not visible, the operator will know the gun is not in a firing mode.

Figure 11:
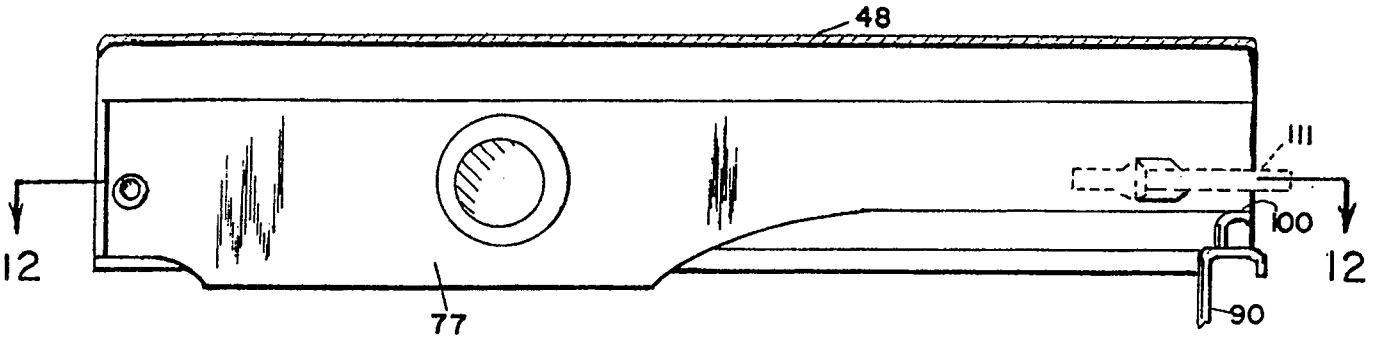
FIG. 11 is a side view illustrating the ejector on the magazine latch positioned in the groove in the bolt.

FIGS. 2 and 3 illustrate the magazine latch 88 having an upper integral part 90 which acts as the ejector. The magazine box 74 has a shoulder 92 which is received in the recess 94 in the spring flange 96 of the latch. Gripping the lip 98 on the flange 96 and moving the flange rearward will release the magazine box. The ejector functions as follows: as the bolt moves rearward, the spring biased extractor 111 removes the shell from the barrel chamber (see FIG. 12). Thereafter, rearward movement of the bolt causes the shell to be engaged by the flange 100 of the ejector (see FIG. 11) and the shell is passed out the opening 102 in the receiver (see FIG. 3).

Figure 4:
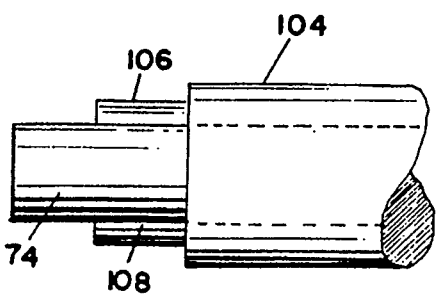
FIG. 4 is a top plane view illustrating the projections on the barrel that align the magazine box to the chamber mouth.

FIG. 4 illustrates that the barrel 104 has spaced projections 106, 108 which receive the magazine. This assures that the magazine is always aligned with the barrel chamber mouth.

Figure 12:
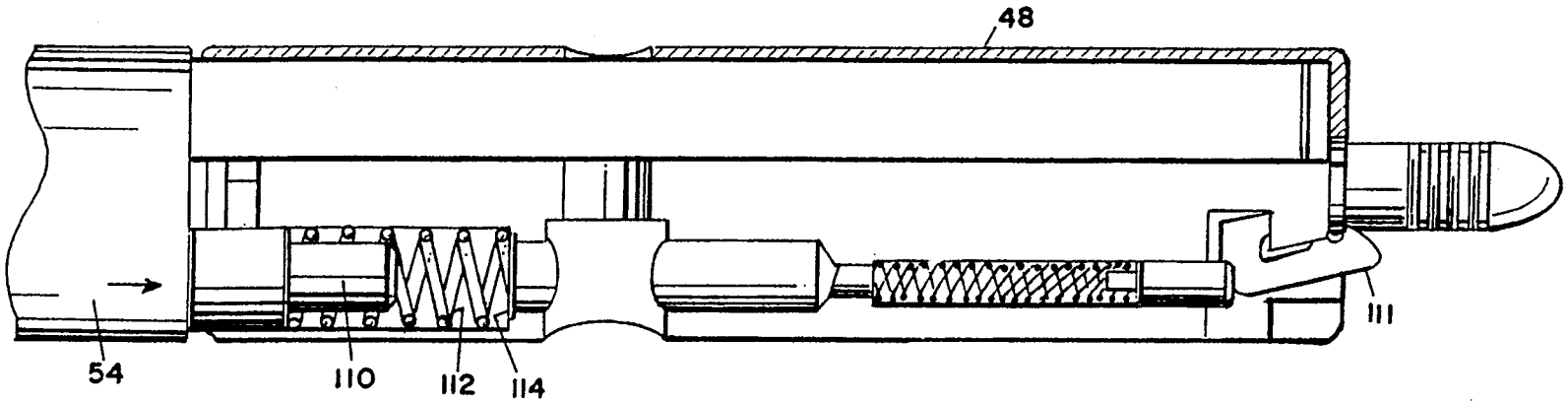
FIG. 12 is a section along Line 12—12 of FIG. 11 illustrating the firing pin retract plunger system.

Reference is now made to FIG. 12 which illustrates the firing pin retract plunger system which prevents the firing pin from interfering with ejection. As the firing pin 56 moves forward and strikes the rim of the shell, the plunger 110 compresses spring 112 positioned in opening 114 in the bolt. Immediately after the forward movement of the firing pin carrier 54, the plunger 110 is moved rearward by spring 112 to force the firing pin carrier rearwardly and remove the firing pin from the shell rim. This prevents the firing pin remaining in contact with shell rim which could interfere with ejection of spent rounds.

Figure 13:
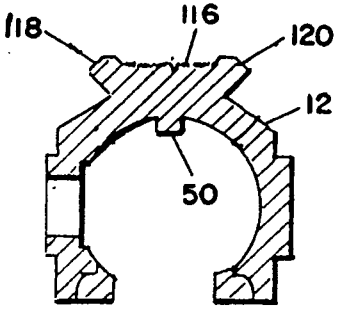
FIG. 13 is a sectional view taken along the Line 13—13 of FIG. 4 and illustrating the scope mount on the receiver.

Attention is also made to FIG. 13 which illustrates the scope mount 116 which is integral with the receiver 12. The scope mount 116 comprises shoulders 118, 120 which can receive the scope.

It can thus be seen that this invention provides for several safety, convenience, and novel operational features for a firearm.

We claim:

1. A firearm having a housing and a receiver and including;

a) a trigger pivotally supported in file housing;

b) a disconnector having a flange adapted to be moved by said trigger;

c) a firing pin carrier slidably disposed in the receiver for movement from a cocked position to a firing position;

d) sear means pivoted in the receiver;

e) spring means normally biasing said sear means into engagement with said firing pin carrier;

f) said disconnector and said sear means coacting to pivot said sear means out of engagement with said firing pin carrier upon disconnector movement; and g) said sear means including multiple sears in side-by-side position and have flanges which coact with the flange on the disconnector each of which must be pivoted out of engagement with said firing pin carrier to permit firing pin carrier sliding movement into a firing position.

2. The firearm of claim 1 wherein said sear means includes a primary sear having a shoulder adapted to engage said firing pin carrier and a secondary sear having a shoulder adapted to engage said firing pin carrier.

3. The firearm of claim 2 wherein the shoulder on the secondary sear is forward of the shoulder of the primary sear.

* * * * *